US007463205B2

(12) United States Patent
Turner et al.

(10) Patent No.: US 7,463,205 B2
(45) Date of Patent: Dec. 9, 2008

(54) DIPOLE ANTENNA FOR A WATCHBAND

(75) Inventors: James B. Turner, Monroe, WA (US); Sean R. Mercer, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 369 days.

(21) Appl. No.: 11/315,543

(22) Filed: Dec. 22, 2005

(65) Prior Publication Data

US 2007/0146218 A1 Jun. 28, 2007

(51) Int. Cl.
*H01Q 1/27* (2006.01)
*H01Q 1/12* (2006.01)

(52) U.S. Cl. ..... 343/718; 343/747; 343/795

(58) Field of Classification Search ..... 343/718, 343/795, 793, 745, 747
See application file for complete search history.

(56) References Cited

U.S. PATENT DOCUMENTS

| | | | | |
|---|---|---|---|---|
| 2,642,528 | A * | 6/1953 | Albright | 343/747 |
| 4,847,818 | A * | 7/1989 | Olsen | 368/10 |
| 5,317,326 | A * | 5/1994 | Tay et al. | 343/718 |
| 5,986,617 | A * | 11/1999 | McLellan | 343/860 |
| 6,281,854 | B1 * | 8/2001 | Ohoka et al. | 343/767 |
| 6,685,634 | B1 * | 2/2004 | Fry | 600/300 |
| 2005/0007885 | A1 * | 1/2005 | Gilmour | 368/13 |
| 2005/0054321 | A1 * | 3/2005 | Casagrande et al. | 455/351 |

* cited by examiner

*Primary Examiner*—HoangAnh T Le
(74) *Attorney, Agent, or Firm*—Kacvinsky LLC

(57) ABSTRACT

An electronic device such as watch adapted for wireless communication, the electronic device using a dipole antenna, the dipole antenna having two component parts, each of which being disposed in respective parts of a two-part connecting band, such as a watchband of the electronic device.

20 Claims, 10 Drawing Sheets

210

DIPOLE ANTENNA FOR A WATCHBAND

BACKGROUND

Portable and hand-held computing and communications devices with wireless communication capabilities often have signal transmission or reception issues depending, for example, on the relative sizes of the devices and/or the signal wavelengths used. Antennas of various types have been used with such devices. Such antennas have radiated or received electromagnetic signals with varying degrees of effectiveness depending upon the physical types, orientations, sizes and/or structural configurations of the antennas, particularly in view of the wavelengths of the signals to be transmitted or received.

Small electronic devices, such as hand-held or wrist-top devices, have typically used loop antennas. In wristwatch types of devices with wireless communications abilities, loop antennas have been disposed as separate elongated loops in one or both sides of a watchband or as a continuous loop extending around the entire circumference of the watchband or watchface. Electromagnetic signal propagation is not very efficient for the elongated loop antennas embedded in each wrist band side of dual sided watchband, such as is used with a common tongue buckle watchband. Such loop antennas often provide a small, weak radiation area and the direction of radiation can be limited as loop antennas typically provide radiation mostly normal to the loop, leaving large areas of little or no signal transmission or reception. Note also that tongue buckles typically preclude the use of the loop antennas wrapping around the circumference of the wrist because the tongue fastener of such a buckle does not generally provide good continuous electrical contact when bringing and holding the two wristband side portions together.

Wristbands have heretofore had loop antennas wrapping around the circumference of the wrist with acceptable efficiency in transmission and reception. Nevertheless, these configurations require a good mechanical buckling for creating an acceptable electrical contact with low losses across the buckle. Such mechanical buckling has heretofore been bulky, causing discomfort in use and a lack of visual appeal. Adjustability of such buckles has also been complicated.

SUMMARY

Implementations described and claimed herein address the foregoing and other situations by providing a dipole antenna in a band of a watch or other electronic device adapted for wireless communication. Such an electronic device has a two-part connecting band, such as a watchband, and the dipole antenna has two component parts, each of which is disposed in respective parts of the two-part connecting band. Such an implementation provides efficient signal radiation, and/or reception. Other implementations are also described and recited herein.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various embodiments and implementations as further illustrated in the accompanying drawings and defined in the appended claims.

DETAILED DESCRIPTION

Technology is described here below for disposing a dipole antenna within an externally disposed band or strap of an electronic device, such as a watchband of a watch, so that the antenna may provide efficient electromagnetic wave radiation transmission and/or reception for the electronic device. As will be described further below, such technology may be useful in a portable computing or communications device, and may be particularly useful in a wrist watch having wireless communication capabilities.

Figure 1:
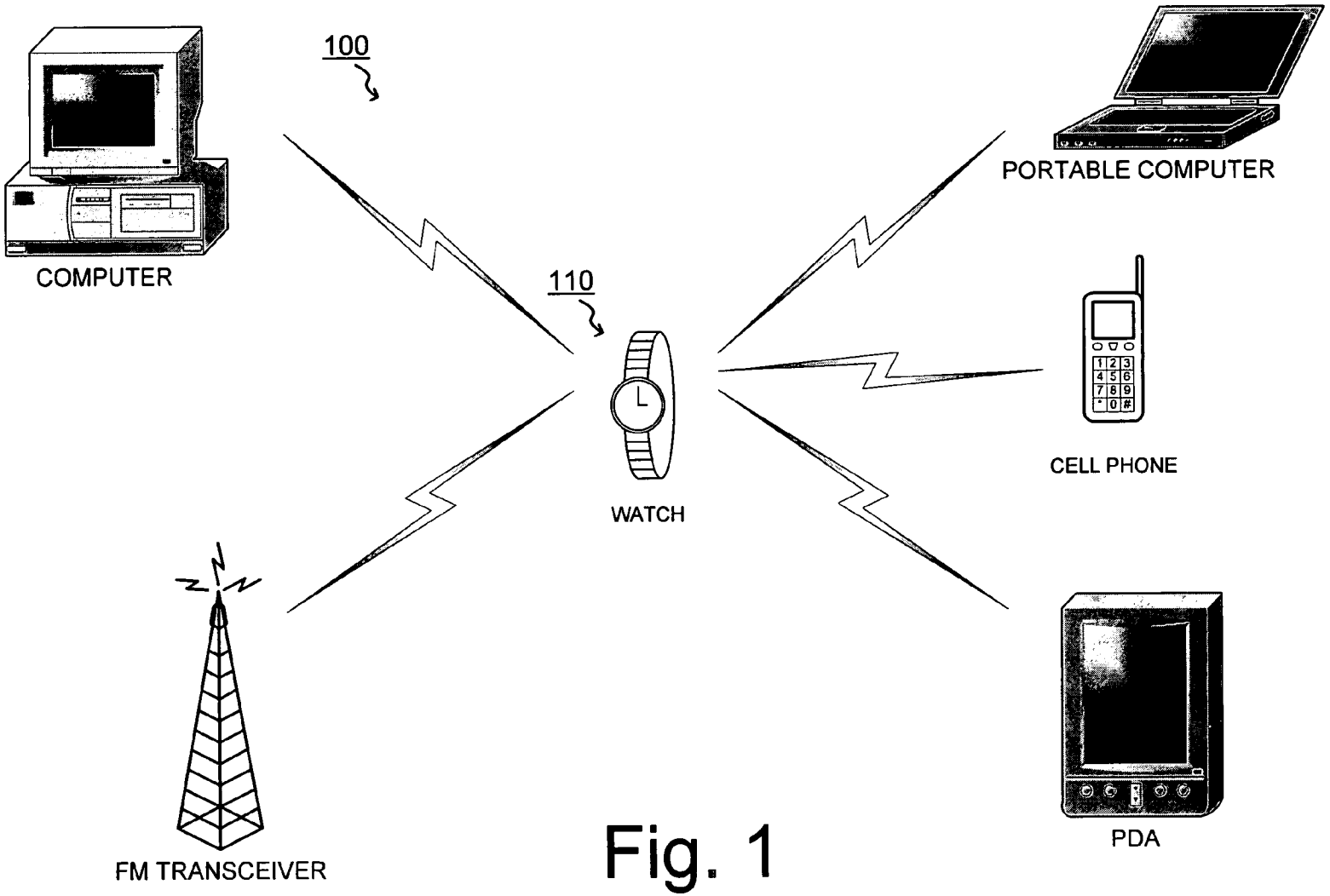
FIG. 1 schematically illustrates a network of wireless communication devices.

FIG. 1 illustrates an example operational system or network 100 for an example watch 110 which may include a dipole antenna. Even though a watch is used as an example here, it may be that other electronic devices having a wireless capability may make use of the described dipole antenna system. As illustrated in FIG. 1, the watch 110 may communicate with other devices within a local area communication network, such as a personal area network or another effective wireless communications network. More particularly, the watch 110 may radiate signals to or receive signals from, and thus communicate with, an FM transceiver, or may communicate with other electronic devices by FM signals or through other wireless means, such as the IEEE 802.15.4 ZigBee standard or through Bluetooth connections. Such other electronic devices may include without limitation a desktop computer, a portable computer, a wireless cellular telephone (mobile or cell phone), and/or a personal data assistant (PDA), inter alia. Note an operational system 100 or the like is only an example of one suitable operational system or environment for an antenna according to the presently-described technology and is not intended to suggest any limitation as to the scope of use or functionality of this technology.

According to this technology, an antenna (not visible in the view of FIG. 1) may be disposed within the watch 110 of FIG. 1, and may more particularly be disposed in the watchband of the watch 110. More detailed descriptions of implementations of such antennas are set forth below.

Figure 2:
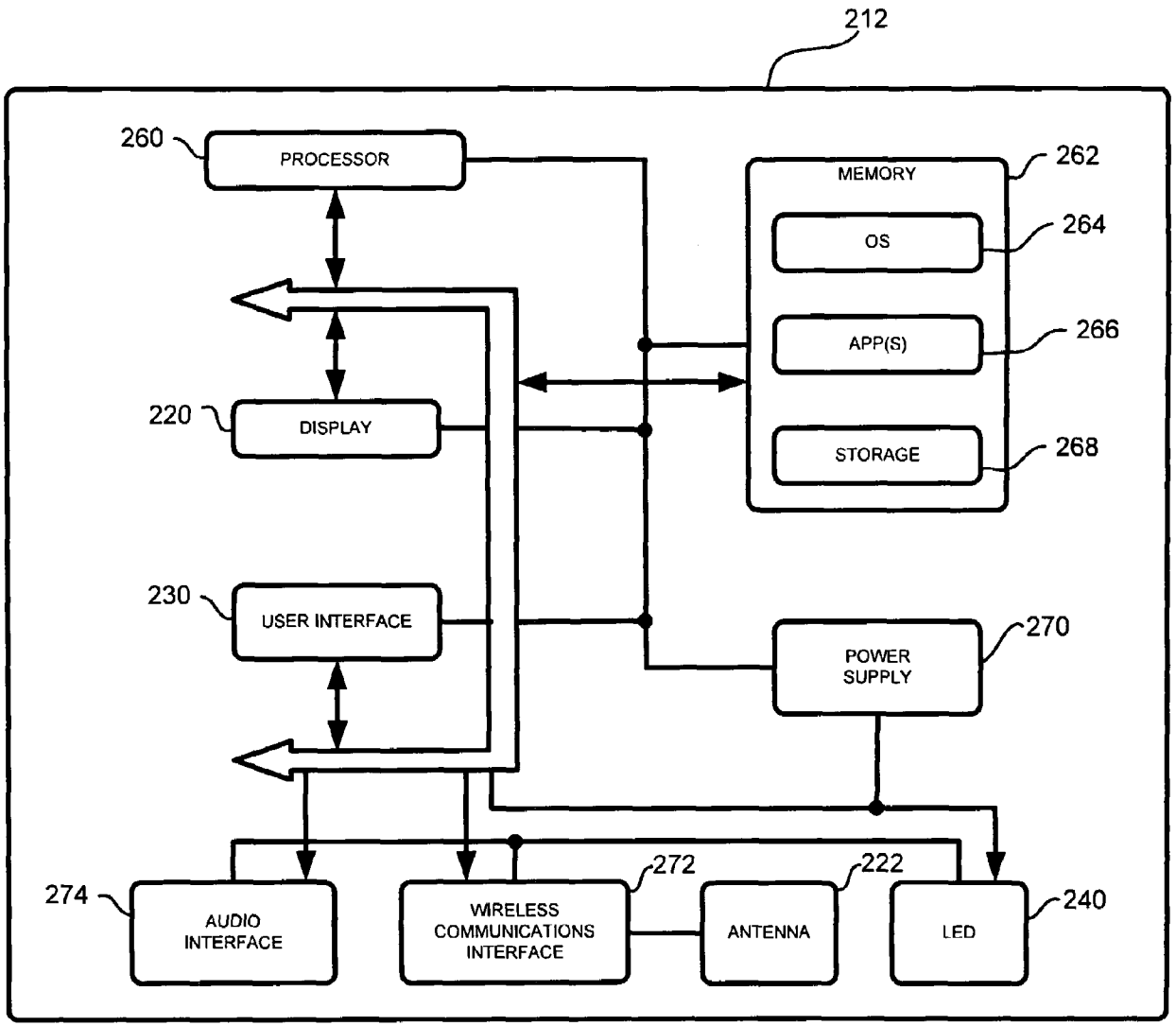
FIG. 2 schematically illustrates the functional components of an electronic device with a wireless communication capability.

FIG. 2 is a schematic diagram of some functional components that may be used in an electronic device 210, such as a wrist watch, that can make use of an antenna as described herein below. The electronic device 210 may include an electrical or electronic system 212, which may include circuitry and/or a computing system having in one example, a processor 260, a memory 262, a display 220, and a user interface 230. The memory 262 may generally include either or both volatile memory (e.g., RAM) and non-volatile memory 268 (e.g., ROM, Flash Memory, or the like). The non-volatile storage 268 may be used to store persistent information that should not be lost if the electronic device 210 is powered down. The electronic device 210 may also include an operating system 264 that may be resident in the memory 262 and may execute on the processor 260. The user interface 230 may include push buttons, a scroll wheel, a numeric dialing pad (such as on a typical telephone), and/or one or more other types of not specifically-enumerated user interface means. The display 220 may include a liquid crystal display, a multiple bit display, or a full color display or any other type of display commonly useful in electronic devices. In one example, the display 220 may be touch-sensitive so that it may act as an input device.

One or more application programs 266 may be loaded into memory 262 and run on the operating system 264. Examples of application programs may include the following non-exhaustive listing of: phone dialer programs, email programs, scheduling/calendaring programs, PIM (personal information management) programs, Internet browser programs, and/or many others, like or even unlike those listed here. The applications 266 may use and store information in the storage 262 and/or 268, such as e-mail or other messages used by an e-mail application, contact information used by a PIM, appointment information used by a scheduling program, documents used by a word processing application, and otherwise both like and even unlike those listed here.

The electronic device 210 may include a power supply 270, which may be implemented as one or more batteries. The power supply 270 might alternatively or additionally include an external power source, such as an AC adapter or a powered docking cradle that recharges the batteries.

The electronic device 210 may also include one or more types of external notification mechanisms; for example, an LED 240 and an audio interface 274, as shown in FIG. 2. The LED 240 may be responsive to programming to provide visual information to the user, such as indicating a powered-on status for the device. The audio interface 274 may be used to provide audible signals to and receive audible signals from the user. For example, the audio interface 274 may be coupled to a speaker for providing audible output and to a microphone for receiving audible input, such as to facilitate a telephone conversation, or as a user interface using voice recognition. In another example, a vibration device (not shown) can be used to give feedback to the user, such as for alerting the user of a newly arrived message. The electronic device 210 may control each alert mechanism separately (e.g., audio, vibration, as well as visual cues).

The electronic device 210 also includes a wireless communications interface 272 that performs the function of receiving and/or transmitting wireless communications, such as radio frequency (e.g., FM) communications or Bluetooth or other communications. The wireless communications interface 272 facilitates wireless connectivity between the electronic device 210 and other receivers, transmitters, networks, devices, etc., either via a communications carrier or service provider or via Bluetooth or like communications with other devices. Wireless electromagnetic wave or signal transmissions and receptions are communicated to and from the interface 272 via an antenna 222. In many implementations, the antenna 222 forms a dipole antenna, although it may take other forms as well. Internal electronic circuitry transmissions to and from the wireless interface 272 may be conducted under control of the operating system 264. Communications received by the wireless interface 272 may thus be disseminated to application programs 266 via the operating system 264, and vice versa, e.g., from the programs 266 and/or operating system 264 to the wireless interface 272. The wireless interface 272 then communicates with the antenna 222 to provide wireless communications for the device 210.

Figure 3:
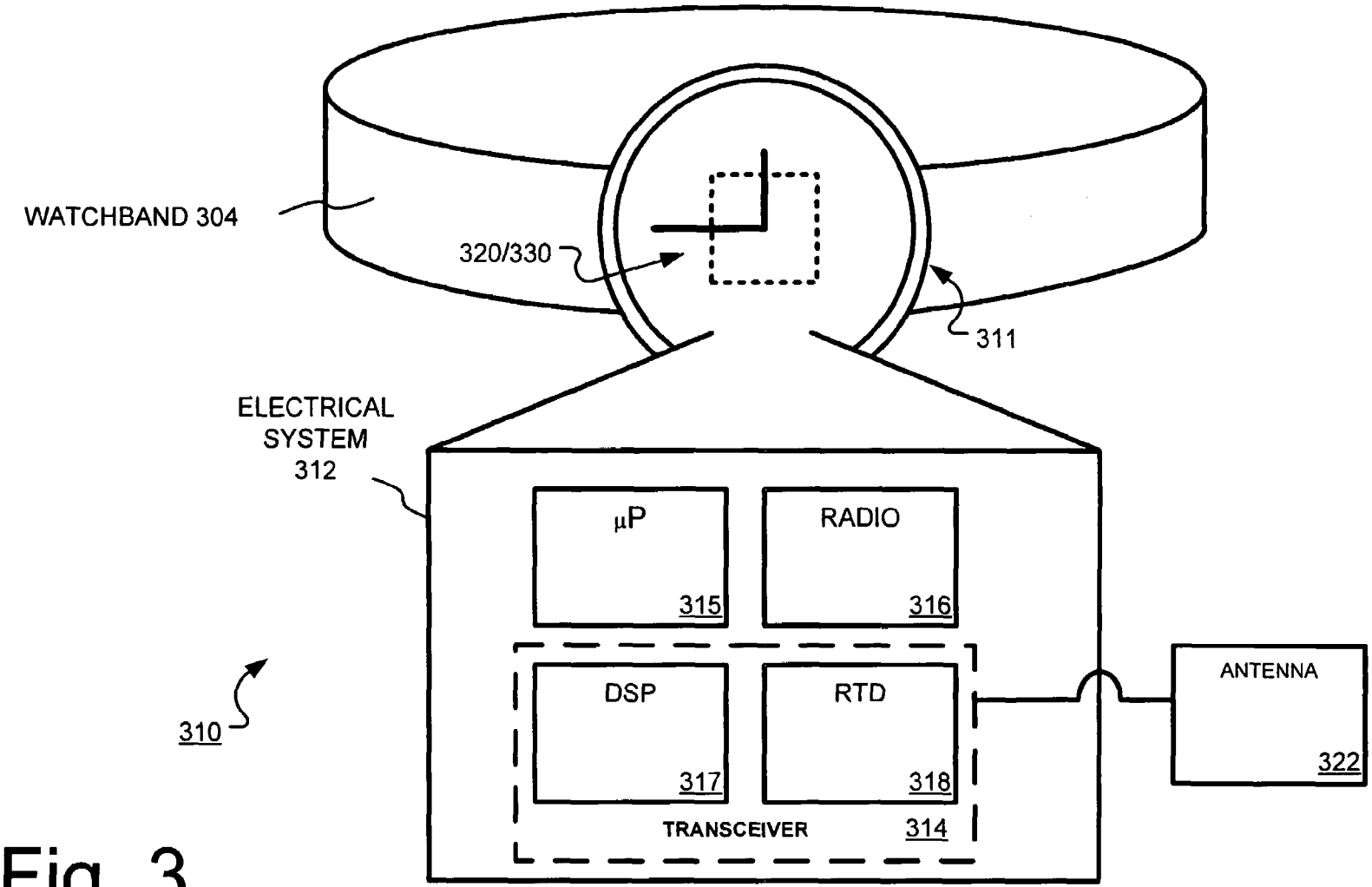
FIG. 3 illustrates a watch with various functional capabilities.

In one example of the described technology, electronic device 210 is a mobile electronic device, such as a watch device that may include a wireless interface. More particularly, FIG. 3 illustrates an example watch device 310 that includes a user display 320 and user interface 330 that may be configured to take advantage of glanceable information technology, inter alia. More generally, the watch device 310 may have a watchband 304 and a watch case 311 attached to the watchband 304. The watch case 311 has an electronic system 312 (see e.g., electronic system 212 of FIG. 2) disposed therein, minimally including one or more electronic components or circuitry or circuit components, and may thus also be referred to as an electronics case 311 or a circuitry case 311 (particularly in non-watch examples). The watch or circuitry case 311 also has disposed therein a display element 320, such as, without limitation hereto, a liquid crystal display, a multiple bit display, or a full color display. Watch hands may be electronically generated on the display 320, may be analog, structural watch hands that do not detrimentally interfere with the display 320, or may be provide some other display means. The watch device 310 may include buttons or other user interface features arranged to operate as a user interface (UI) 330. Note the user interface may be on or may be a part of the display 320 (as shown schematically in FIG. 3) or may be separate therefrom, and may be on or otherwise connected to the case 311.

The electronic system 312 may be a computer-based or computer-like system, including functionality of operating as either or both a transmitter and/or a receiver, and may thus be or include a transceiver. Consequently, as illustrated in FIG. 3, the electronic system 312 may include a transceiver 314 (schematically represented), a microcomputer unit or microprocessor (μP) 315, and in some implementations may include an analog radio 316. An antenna 322 (see more detailed descriptions in relation to FIGS. 4, 5, 6 and 7) may be connected to the transceiver 314 for emitting and/or receiving information signals. The transceiver 314 may generally include a digital signal processor (DSP) 317 to perform control, scheduling, and post-processing tasks for the transceiver. Also included in the transceiver 314 may be a real-time device (RTD) 318, which in turn may include a digital radio, system timing, and real-time event dispatching. The DSP 317 may be coupled to the microprocessor 315, and transceiver tasks can then be commanded by the microprocessor 315.

As introduced above, an antenna or antenna system is presently-described for an electronic device having a wireless communication capability. More particularly, a dipole antenna is shown and described as disposed on or within a connecting band or strap of an electronic device, such as a watchband of a watch, for improving transmission and/or reception of electromagnetic signals. As will be further described with respect to FIGS. 4-8, the antenna may thus be disposed in an electromagnetically exposed disposition relative to the electronics case. Though not limited to watches in all implementations, the described implementations present the electronic devices as smart watch type devices that are configured to receive and/or transmit wireless communication signals.

Figure 4:
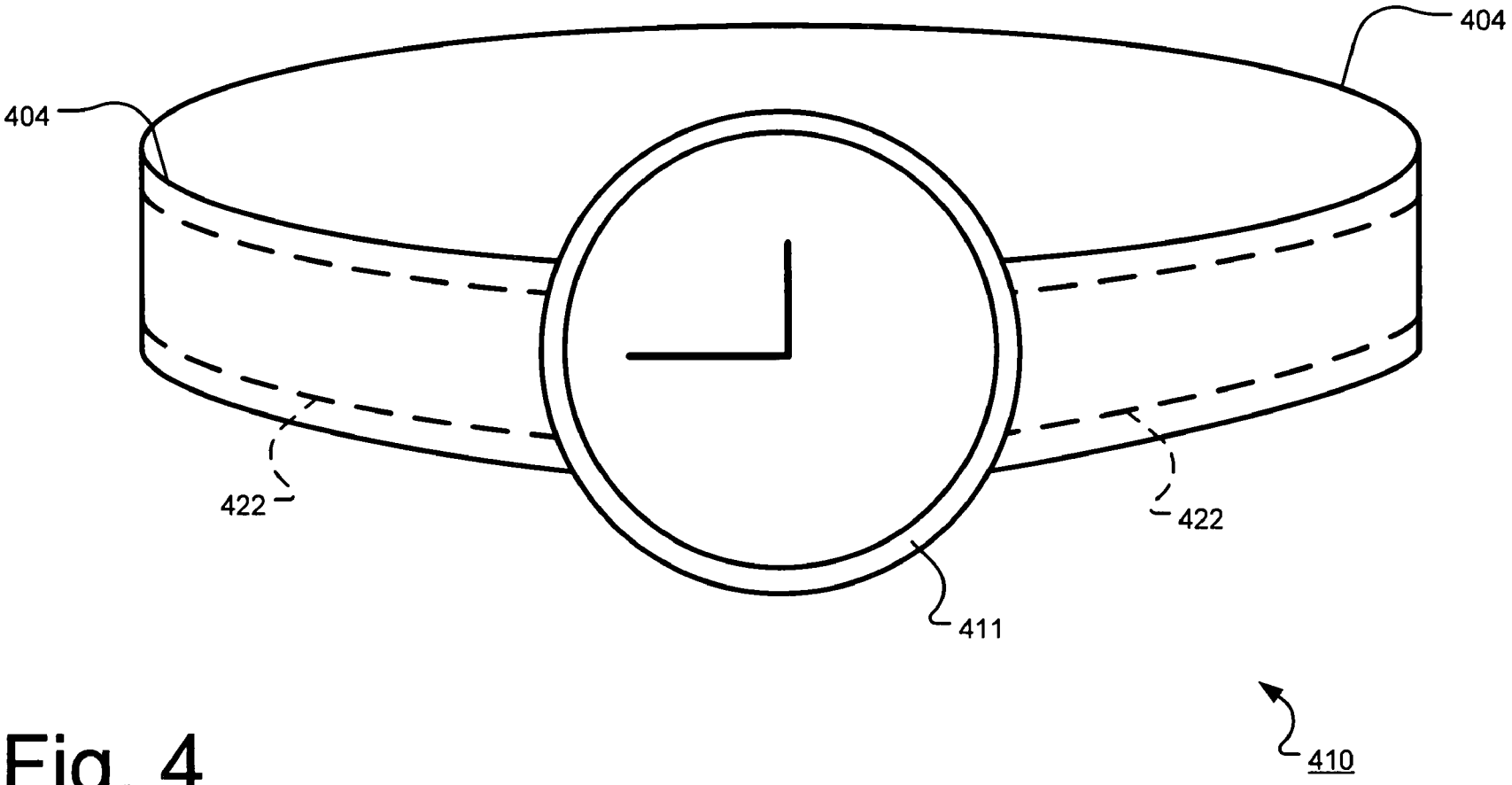
FIG. 4 illustrates a watch having a dipole antenna embedded in the band.

FIG. 4 presents a view of a watch device 410 having the presently-described technology incorporated therein. More particularly, such a watch device 410 has an antenna 422 disposed within the band 404. The antenna 422 is shown in FIG. 4 (in dashed lines) disposed adjacent and/or in an electromagnetically exposed disposition relative to the electronics or circuitry case 411 of the device 410. Note, an electromagnetically exposed disposition may include without limitation having the antenna disposed externally or outside of the electronics case 411, and on, in or otherwise adjacent to or as part of the watchband 404. Note, the watchband 404 may be of a non-shielding or electromagnetically transmissive material, such as a leather or plastic material, so as not to interfere substantially with the radiation reception and/or transmission capabilities of the antenna 422. Some otherwise shielding materials, such as metals, could alternatively be used in some instances. For example, in some implementations, the antenna may either be visible on or through the band 404, or indeed may constitute the majority or the entirety of the band itself. In some such instances, the metal material may form some or all of the structural part of the band, as well as forming the dipole antenna.

Figure 5:
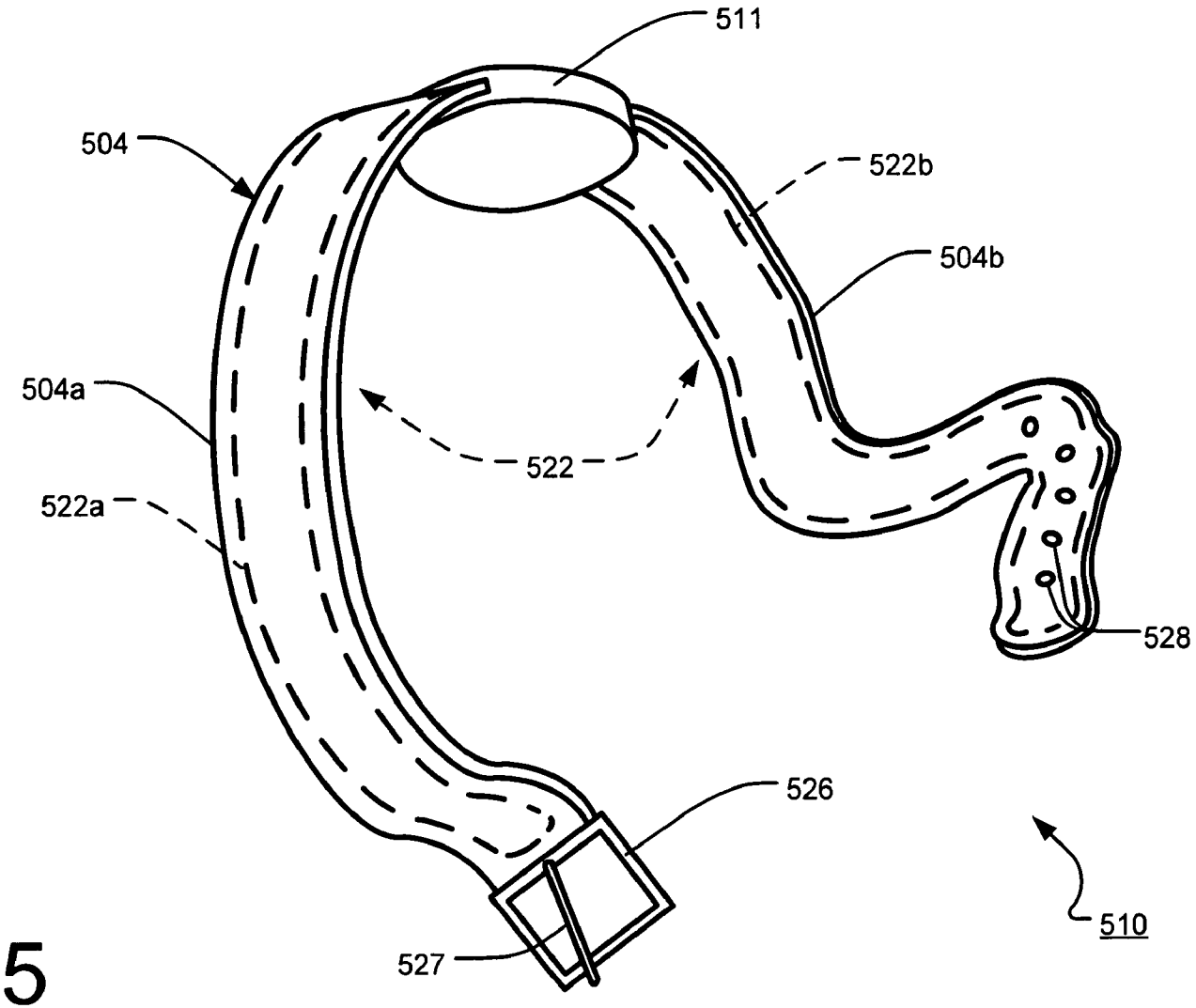
FIG. 5 illustrates an isometric view of a watch having a dipole antenna.

With reference now to FIG. 5, a dipole antenna 522 is shown (here also in dashed lines) disposed within a watchband 504 of a watch device 510. The antenna 522 is thus disposed outside the case 511 which is also an electromagnetically exposed disposition relative to the case 511, and thus provides for avoiding a substantial amount of the electromagnetic shielding of the case 511. Antennas used in a variety of prior watch types of devices have been disposed within the watch case, and many such cases are made of metal or like materials that can shield electromagnetic radiation, particularly for an antenna disposed therewithin. In removing the antenna 522 from within the case, the antenna 522 is thus also removed or disassociated from the electrical circuitry (see FIGS. 2 and 3) that nevertheless remains disposed within the case. Even so, the antenna 522 will be electrically connected to the electrical circuitry via connection stems (see FIG. 6 and description relative thereto) that extend into the case 511. Disassociating the antenna 522 from the circuitry and moving it to a position outside of the case 511 will typically increase the effectiveness of signal propagation and reception of the antenna 522.

Note also that as shown in FIG. 5, the antenna 522 is rather disposed as an antenna system 522 of two component antenna parts or first and second arms 522*a* and 522*b* in respective first and second watchband side portions 504*a* and 504*b*. Separated this way, the antenna system 522 can be a dipole antenna, which is an antenna with two separate driven elements, here elements or arms 522*a* and 522*b*. These elements then separately connect to and communicate with the electronic circuitry, and particularly to the antenna driving circuit (see FIG. 9 and description, below). As is understood of dipole antennas generally, then, these separate elements 522*a* and 522*b* can be fed (and/or may receive) the same signals, only 180 degrees out of phase with respect to each other.

Provision of two separate elements 522*a*, 522*b* allows for use of a conventional tongue buckle 526 for fastening the watchband 504 on a user's wrist. As is typical for such buckles, the tongue 527 engages one of the buckle holes 528 on the second watchband side portion 504*b* to fasten the band 504.

Figure 6:
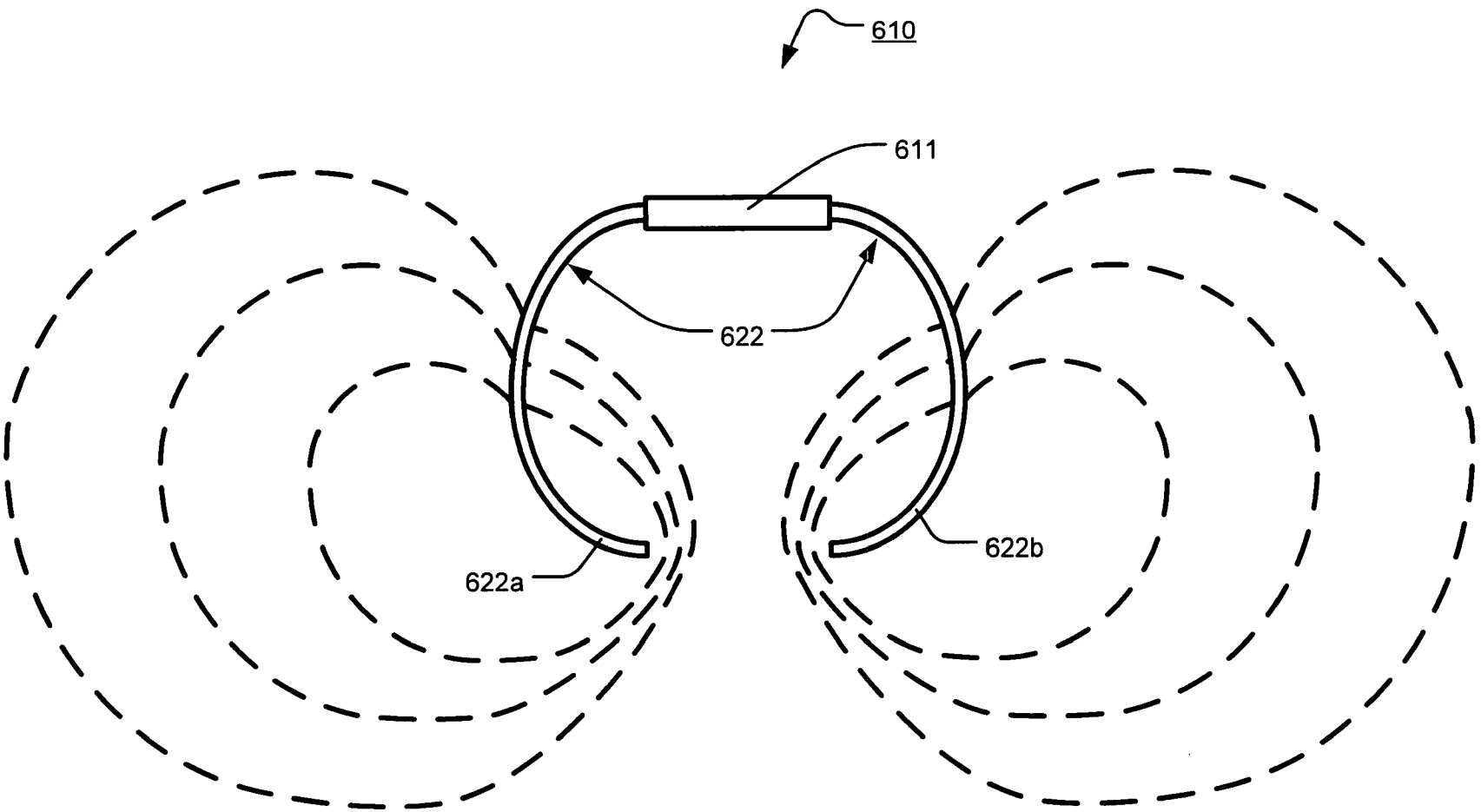
FIG. 6 illustrates a radiation pattern for a watch having a dipole antenna.

FIG. 6 provides a view of a radiation pattern of a dipole antenna 622 implemented in a watch 610. The emanating radiation is in this example, generally spherical (though only two dimensions are shown in FIG. 6), with some reduction in sphericity (similarity to a sphere) due to interference from the other dipole portion. As these dipole portions or arms 622*a* and 622*b* diverge from a co-planar, pure dipole relationship, each of the arms can provide an interference with the other arm, particularly near the respective ends of the respective antenna arms 622*a* and 622*b*, as these ends approach each other. Other interference factors may come from the case 611 and the user's wrist (not shown in FIG. 6), etc.

Note, as the present use of a dipole antenna diverges from the more typical dipole orientation of a substantially co-linear or co-planar, advantages and disadvantages arise. For example, a co-linear dipole antenna provides the best pickup or gain, but, such a dipole also has transmission nulls (i.e., areas of cancelled signals from the interference of two or more antenna elements in an antenna system) out the ends of the extending dipole arms. A dipole with a non-co-linear orientation will have less prominent nulls and can thus provide a better transmission/reception pattern.

Figure 7:
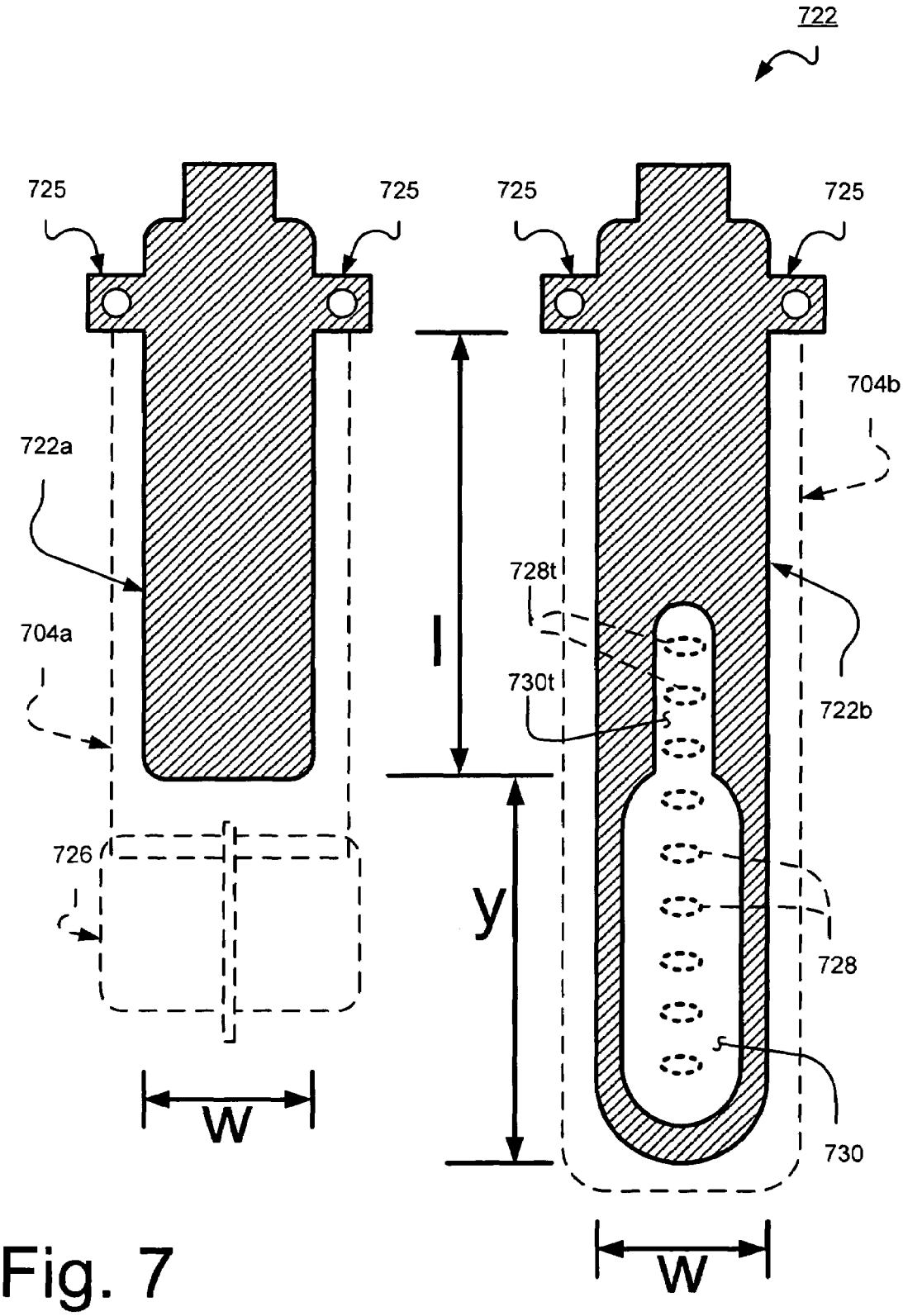
FIG. 7 is a plan view of two parts of a dipole antenna usable in a watch.

FIG. 7 provides a view of an antenna system 722 of two component parts 722*a* and 722*b*. These antenna component parts 722*a*, 722*b* are shown relative to dashed line representations of respective watchband portions 704*a* and 704*b*. Also shown in dashed lines are a tongue buckle 726 and buckle holes 728. Each of these antenna component parts 722*a*, 722*b* has one or more electrical connection stems 725 that are disposed to make electrical connection with the circuitry (see FIGS. 2 and 3) within the watch case (see e.g., cases 411, 511 and 611). The connection of these electrical connection stems 725 to the electrical circuitry may take place in understood fashion, whether disposed within or having lead connections reaching through the corresponding case.

In some implementations, both component elements of the dipole antenna 722 are identical or nearly so, and both are like component part 722*a*, each having the same or substantially the same effective radiation/reception length, here shown as length l. In dipole antennas generally, the two separate elements would typically be of equal (or substantially equal length), with the combined length of the two separate elements providing the wavelength of the antenna as a whole.

In general, many implementations may be more functional if the arms of the dipole antenna provide the longest combined length possible and/or reasonable (with variable tuning means in the driving circuit, see FIG. 9 below). However, in practice, some interference may be found as the ends of the two dipoles wrap around the wrist and come closer together (see the radiation interference of FIG. 6). Furthermore, many watchbands will have an overlapping part or overlapping end of one side portion of the watchband relative to the other side portion (as described further below, such as for the accommodation of a tongue buckle like the buckle 526 shown in FIG. 5), which can create an interference for a dipole antenna. First, an overlapping part of any dipole antenna may create an unwanted capacitance in the overlapping antenna portions and thus reduce the radiation efficiency of the overall antenna. To address this unwanted capacitance and consequent reduction in radiation efficiency in one implementation of a watchband antenna 722, one component element, here element 722*b*, e.g., may be made longer than the other, e.g., element 722*a*, and provided with a cutout area, or aperture 730 to reduce the effective radiation area in the overlapping portion of the dipole antenna. The effective radiation length l of the respective first and second component elements 722*a*, 722*b* may thus be provided to be or remain substantially the same as shown in FIG. 7. The longer length y of the element 722*b*, beyond length l (below the length l in FIG. 7) provides for the overlap of the two component elements to accommodate the buckling/fastening function; while nevertheless, the aperture area 730 minimizes the radiation loss of this overlapping length y, reducing the interference and/or capacitance created therebetween.

Moreover, it may be that in some circumstances, the overlap with the extended portion y may be provided to improve the manufacturability of the device, by easing assembly of the antenna system within the watchband. By making the antenna portion or element 722*b* longer (l+y), it will then be predisposed to fit within a corresponding watchband portion of the same substantial length, without allowing for any movement or improper positioning of the antenna component 722*b* therewithin during assembly. The antenna portion 722*b* will thus not improperly move or have any tendency to move out of position during assembly, and will not require any additional means for holding or securing it in place within the watchband.

Aperture 730 also provides for the disposition of through holes or buckle holes 728 (shown in dashed lines) for a tongue buckle, if used. The holes 728 are formed in the watchband itself and thus not directly shown here, rather only in phantom, dashed lines. Moreover, though not required, but if size and adjustability criteria suggest that one or more buckle holes 728*t* should be disposed within the effective radiation area (again, as denoted by length l) of the antenna portion 722*b*, then a thinner aperture portion 730*t* may be provided to accommodate these holes 728*t*. The aperture portion 730*t* would reduce the radiation ability of this antenna portion 722*b*, at least in this cutout area, but this may be a small and desirable trade-off in view of the other interference issues (see FIG. 6 and description thereof), as well as in view of providing the ability for a desirable amount of adjustability of the watchband circumference.

Figure 8:
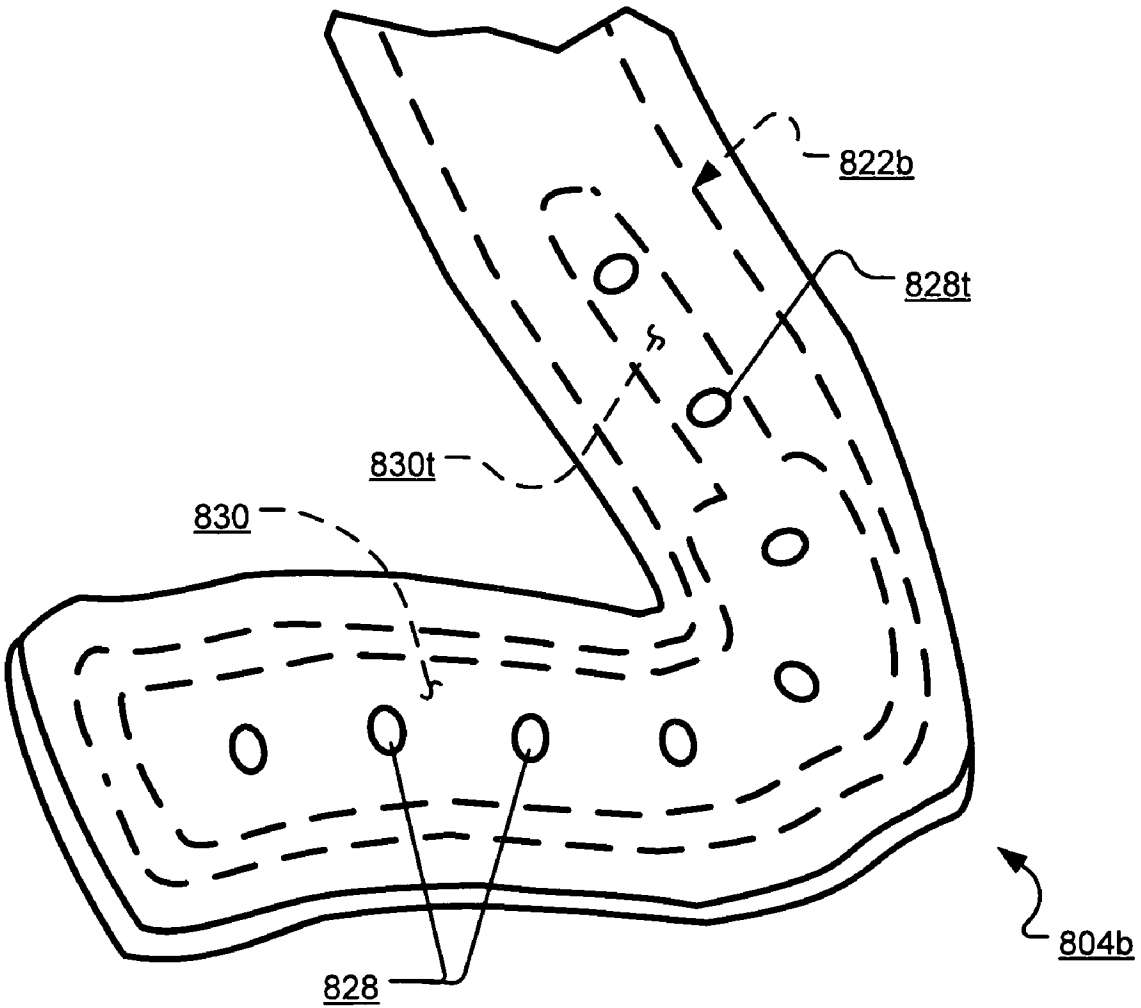
FIG. 8 illustrates a section of a watchband with a portion of a dipole antenna.

FIG. 8 provides a view of an overlapping end of a watchband portion 804*b* with an antenna portion 822*b* (in dashed lines), like portion 722*b* of FIG. 7. An aperture 830 (also in dashed lines) is shown as it would accommodate a number of buckle holes 828. Also shown is a reduced or thinner aperture portion 830*t* for the accommodation of one or more additional buckle holes 828*t* in the radiation area of the antenna portion 822*b*.

Note the width w of each of the components 722*a*, 722*b* of FIG. 7 contributes to the radiation area (l×w), and thus also may be made as wide as functionally or cosmetically and/or fashionably reasonable. One reason for this is that the impedance goes down with a wider antenna. Similarly, the cutout area, particularly that cutout area 730*t* appearing within the radiation area (l×w) should be made as thin as possible to functionally accommodate the tongue, yet minimally reduce the effective radiation ability of the antenna component 722*b*.

The antenna may be disposed, inter alia, within the watchband as described, or may be disposed on or attached to the top surface of the watchband or, it may be connected to another outer surface, such as the under surface of the watchband. Even so, the wrist and/or skin of a user can create an undesirable capacitance with the antenna causing loss or inefficiency. Thus, it may prove more effective to maximize the distance between the wrist and the antenna, thus suggesting a maximally thick inner layer of the watchband separating the antenna from the skin. Nevertheless, cosmetic or style considerations will likely also provide a rational limit on this inner watchband thickness. It is currently believed that thinner watchbands may be more cosmetically attractive to, as well as less cumbersome in use for, end-users. In many instances, the antenna may be sandwiched between watchband layers, as for example between inner and outer layers of a band. These dispositions may be provided for any of various reasons such as for aesthetics: i.e., though an exposed, viewable antenna may be attractive in some cases, such an exposed antenna may more typically not be consumer-friendly. Thus, in many implementations, the antenna will be covered with some watchband material, such as for example a leather or a plastic that obfuscates view of the antenna. Moreover, hiding the antenna allows more variability in watch style or fashionability.

In other cases, the antenna may be positioned for enhancing operability as it would if it were exposed with no potentially interfering watchband material disposed thereover. In some implementations, the majority of or the entirety of the watchband may be made of antenna material, and thus form the antenna. In some other cases, however, it may be that some watchband materials may be implemented that magnify the electromagnetic signal transmission and/or reception. For example, it may be that disposition of a metal antenna in or under or in other association with some plastics in or of the watchband may enhance operability. Even so, the material of the watchband may in many still further cases at least provide a non-shielding characteristic to avoid interfering with the signal transmission or reception. However, it may still be that some watchband materials may provide shielding characteristics and may yet be accommodated by choice of antenna size and/or material, or by choice of antenna driving circuitry.

As for watch considerations, when given no constraints, the dipole antenna would be set for a total length equal to one wavelength and have no surrounding metal or absorbing or shielding material. But in actual application, the surroundings are often constrained by other design choices. A form factor consideration is the size of the watch, and in particular the watchband. For the popular Industrial Scientific Medical unlicensed band of 2400 to 2483 MHz, the wavelength in air is 123 mm (which is about or a little greater than 4.8 inches). This means the length of the antenna may be made to equal or be substantially near to 123 mm or a little more than 4.8 inches in length for use with this wavelength. For a dipole antenna, each portion of the antenna would form half the overall length, thus each would be about 61.5 mm or a little more than 2.4 inches in length. This size of a dipole may fit in the length of a watchband of an ordinary watch (even though, or particularly because the watchband wraps around the wrist).

As for types of antennas, an antenna hereof may be formed from an electromagnetically active material, such as one or more metals. For example, copper, beryllium, gold, or silver or a combination of two or more of these may be used. Combination examples include layering copper and beryllium or using a layer of silver and a layer of gold, sometimes with a core barrier metal layer. The skin depth of a gold or silver antenna may be approximately (~) 1.6 micrometers at 2.45 GHz. In many implementations, the material of and relative thickness of the antenna will have or provide some flexibility or pliability for conforming the antenna to a user's wrist. Other implementations may involve less flexible or perhaps even non-flexible materials and thicknesses, in which cases, the antenna and band may be pre-configured to fit one or more user's wrists. Moreover, such a dipole antenna may thus provide a classic type of radiation profile, particularly for a non-linear dipole (see FIG. 6) (note this pattern or profile would typically be similar to an inverted V dipole, also referred to as inverted rabbit-ears). With this skin depth of gold or silver and a core of barrier metal the radio frequency (RF) loss may be low. This antenna is generally of an inverted V shape but for the curved circumferential wrapping around the wrist. As understood, this allows an antenna feed circuit to drive the antenna easily and reliably. A feed or matching network of many known types may be used. The final matching of the antenna to the transceiver integrated circuit (IC) is accomplished by discrete inductances (Ls) and capacitances (Cs).

Moreover, an optional further aspect of the presently-described technology may include an automatic or substantially automatic tuning of the antenna. For loop antennas of the state of the art, tuning is typically achieved by electrically controlling the capacitance to resonate the inductance of the antenna. A simplified tuning circuit 900 for a dipole antenna is shown in FIG. 9 where the dipole antenna is represented by a resistance load 901 and capacitance with printed circuit board capacitance and receiver integrated circuit capacitance all depicted as a single capacitor 904, and is disposed in a circuit with a variable capacitance 902 and an inductance 903. The two arms 922*a* and 922*b* of a dipole antenna are shown as they schematically feed the resistance 901. A variable capacitance provides the best signal to noise ratio at the radio integrated circuit (IC). But for dipole antennas, the simplified source impedance is resistive and capacitive, so an electrically controlled variable inductance (variability shown as a dashed line arrow on inductor 903 in FIG.9) would provide the most efficient tuning component as opposed to a variable capacitor. However, though operable, such inductive components are not typically conventionally available at 100 MHz usage and also are not generally available for integrated circuit realization. Switched inductors may instead be used as shown in FIG. 10 (described below), but the cost, size and bandwidth limitations may be such as to cause the end product to be unappealing as a consumer item. To counter this, an optimal fixed value of an inductor 903 (without the optional variability shown by the dashed line arrow) may be chosen and combined with a small amount of variable capacitance 902 to resonate the system. In some watch-type applications a 120 nH small smd part may be used, though the sizing may depend upon the particular application.

As introduced as an alternative above, a set of switchable inductors, as for example, two or more inductors could be switched and less variation tuning capacitance thus needed to allow even better sensitivity but the cost of the final unit would increase. Three such inductors (L1, L2 and L3) are shown in a set 1002 in the circuit of 1000 FIG. 10. An antenna load 1001 may be driven by arms 1022*a* and 1022*b* as above, and a variable capacitor 1003 may be used. With the switch combinations available through the use of the two switches S1 and S2, four different effective inductances may be available. For a first example, if both switches S1 and S2 are open as shown, then the combined inductance of L1 and L2 would be provided. If S1 is closed, then only the inductance of L1 would be provided. If S1 and S2 are closed, then the combination of L1 and L3 would be provided. The fourth option would be the opening of S1 and the closing of S2 which would then provide an inductance from all of L1, L2 and L3. These four options of inductance could then be used with the variable capacitance of capacitor 1003 and fixed capacitance 1004 to provide ample tuning for the antenna at 1001.

For such an implementation, a MEMS (micro electromechanical system) switch may be used to make the switching between inductors because the making of a solid connection, or a good electrical contact between paths to inductors, i.e., shorting out or interrupts the path that goes to an inductor (particularly, a high Q inductor) is difficult with integrated circuit or CMOS switches. Moreover, the inductors would likely be more optimally operational if put at right angles to each other so they would not interfere with each other. Such an orientation could be more optimum so as to more completely tune with inductors that would be better than tuning with variable capacitors which may have a little more loss associated therewith.

Figure 9:
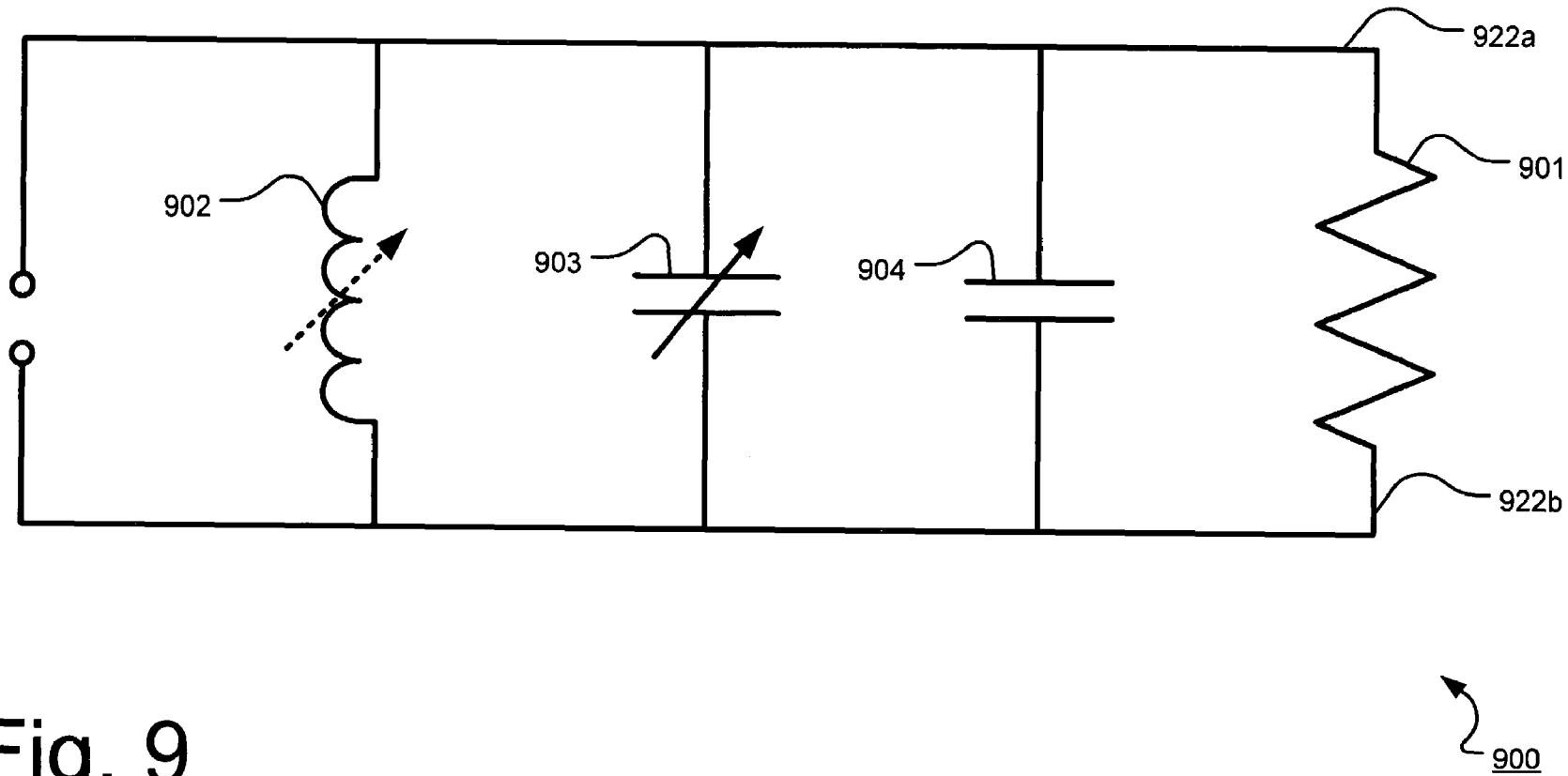
FIG. 9 illustrates a circuit diagram for a dipole antenna.
Figure 10:
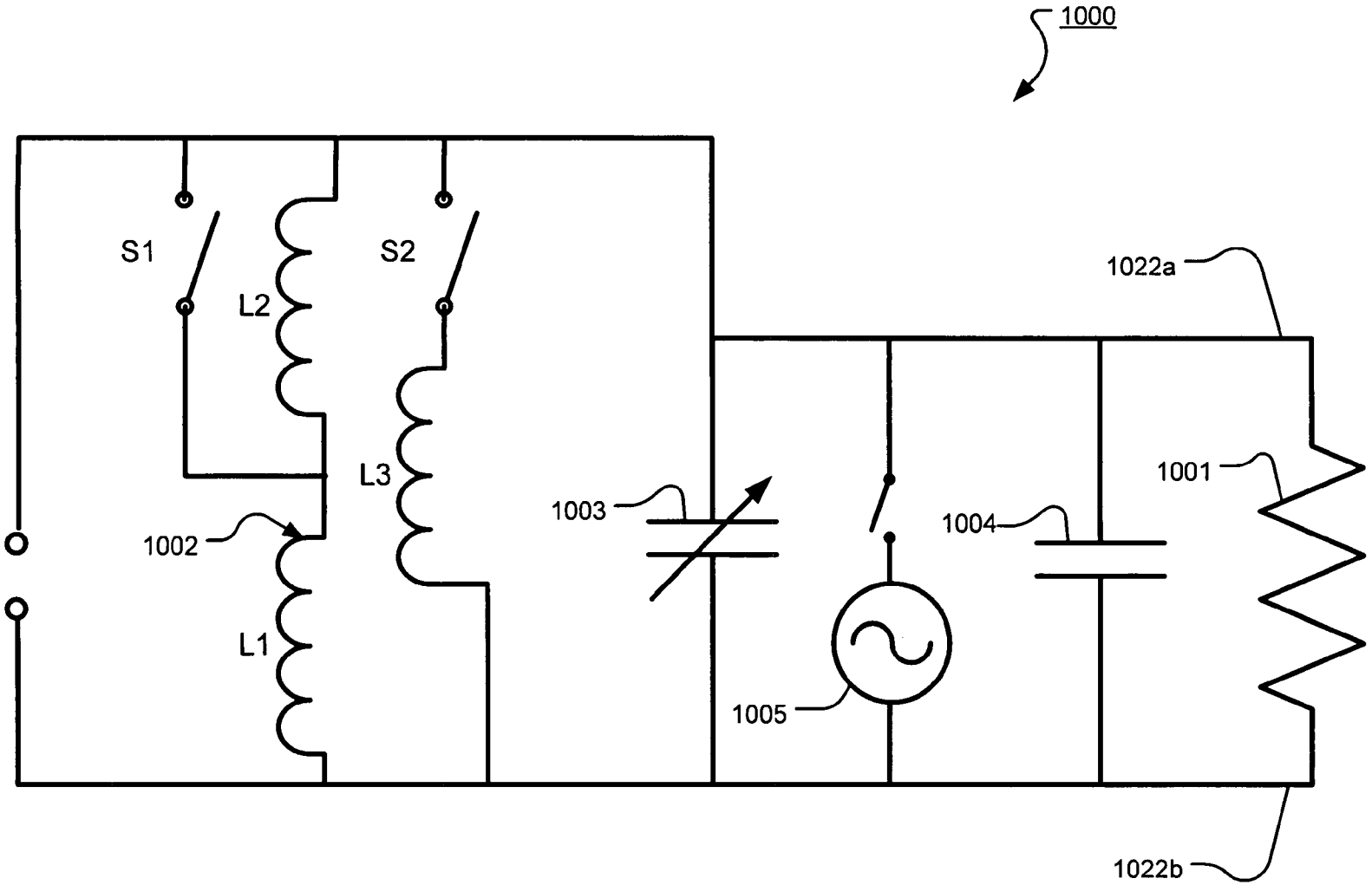
FIG. 10 illustrates one further circuit diagram for a dipole antenna.

Moreover, an oscillating member 1005 may be used to power the automatic tuning of the circuit 1000 (such a device could also be used in the circuit 900 of FIG. 9, though not shown there). Such a member could be switched on automatically or by software, as at start-up, or whenever data is requested by the electronic or watch device. When data is received, then the automatically varying features may be stopped by switching off the member 1005, the antenna then resonating with the values of inductance and capacitance found during the automatic tuning cycle. The oscillating member 1005 may also be configured to be switched on at regular, pre-defined intervals, or whenever a data request is made, or a combination of both.

The result is as described herein an antenna which is attachable to or enclosable within an electronic device band externally of the device, yet nevertheless providing the electronic device with wireless communications abilities for communications with computers, laptops, cell phones, headsets or the like, as for example, by FM or Bluetooth communications. With computers, for example, electronic file(s) may be transferred through the air wirelessly, and perhaps automatically when in Bluetooth range. Music listening options may be enhanced with Bluetooth communications of songs on a watch or the like to a headset. Health and/or exercise-related devices such as those for monitoring physical signs (respiration, heart rate, etc.) may be enhanced by wireless communications to a computing-enabled watch hereof or the like. Other smart personal objects or personal artifacts may also communicate herewith as well.

The above specification, examples and data provide a complete description of the structure and use of example implementations of the presently-described technology. Although various implementations of this technology have been described above with a certain degree of particularity, or with reference to one or more individual implementations, those skilled in the art could make numerous alterations to the disclosed implementations without departing from the spirit or scope of the technology hereof. Since many implementations can be made without departing from the spirit and scope of the presently described technology, the appropriate scope resides in the claims hereinafter appended. In particular, it should be understood that the described technology may be employed independent of a watch, a computer or like deceives. Other implementations are therefore contemplated. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular implementations and not limiting. Changes in detail or structure may be made without departing from the basic elements of the present technology as defined in the following claims.

Accordingly, what is claimed is:

1. An electronic device adapted for wireless communication, the electronic device comprising:

an electronics case;

electronic circuitry disposed within the electronics case, the electronic circuitry providing for wireless communication;

a band connected to the electronics case; and, a dipole antenna disposed within the band and electrically coupled to the electronic circuitry to provide for one or both of electromagnetic signal transmission and reception, the dipole antenna comprising first and second component parts, the second component part of the dipole antenna having an aperture defined therein within a width of the second component part and through a thickness of the second component to reduce interference between the first and second component parts of the dipole antenna.

2. An electronic device according to claim 1 wherein the band is an electromagnetically transmissive band.

3. An electronic device according to claim 1 wherein the dipole antenna is disposed in an electromagnetically exposed position relative to the electronics case.

4. An electronic device according to claim 1 wherein the band has first and second side portions, the first component part being disposed within the first side portion of the band, and the second component part being disposed within the second side portion of the band.

5. An electronic device according to claim 4 wherein the second side portion of the band is of a length that provides an overlapping end, wherein the overlapping end overlaps a portion of the first side portion of the band, and wherein the second component part of the dipole antenna has the aperture defined therein with a length at least as long as the overlapping end of the second side portion of the band.

6. An electronic device according to claim 4 wherein the band has a tongue buckle attached to the first side portion of the band for fastening together the first and second side portions.

7. An electronic device according to claim 6 wherein the second side portion of the band has one or more buckle holes for engagement with the tongue buckle, and wherein the aperture defined in the second component part of the dipole antenna accommodates one or more of the one or more buckle holes.

8. An electronic device according to claim 6 wherein the second side portion of the band is of a length which defines an overlapping end, the overlapping end being adapted to overlap a portion of the first side portion of the band, and the overlapping end being adapted to accommodate the tongue buckle for fastening together the first and second side portions of the band.

9. An electronic device according to claim 8 wherein the second side portion of the band has one or more buckle holes for engagement with the tongue buckle, and wherein the aperture defined in the second component part of the dipole antenna accommodates one or more of the one or more buckle holes, and wherein at least one of the one or more buckle holes is disposed in the overlapping end of the second side portion of the band.

10. An electronic device according to claim 9 wherein the aperture is defined in the second component part with a length at least as long as the overlapping end of the second side portion of the band.

11. An electronic device according to claim 1 wherein the electronic device is a watch, and wherein the band is a watchband.

12. An electronic device according to claim 1 further comprising a tuning circuit for the dipole antenna, the tuning circuit including:

a fixed value inductor, and, a variable capacitor disposed in parallel with the fixed value inductor, wherein both the fixed value inductor and the variable capacitor are disposed in parallel with the dipole antenna.

13. An electronic device according to claim 12 further including an oscillating member to automatically switch on the tuning circuit.

14. A dipole antenna adapted to be disposed in operative association with a watch, the watch having a watch case with electronic circuitry disposed within the watch case; the watch being adapted for wireless communication, the dipole antenna being connected to the watch case and forming a watchband, the dipole antenna also being disposed in electrical communication with the electronic circuitry and disposed to provide for one or both of electromagnetic signal transmission and reception, the dipole antenna comprising:

first and second component parts of an electromagnetically active material disposed in an electromagnetically exposed disposition outside of the watch case, and disposed to one or both receive or transmit electromagnetic signals, the second component part of the dipole antenna having an aperture defined therein within a width of the second component part and through a thickness of the second component to reduce interference between the first and second component parts of the dipole antenna.

15. A dipole antenna according to claim 14, the first component part forming a first side portion of the band, and the second component part forming a second side portion of the band.

16. A dipole antenna according to claim 15 wherein the second side portion of the band is of a length which provides an overlapping end, wherein the overlapping end overlaps a portion of the first side portion of the band, and wherein the second component part has the aperture defined therein with a length at least as long as the overlapping end of the second side portion of the band.

17. A dipole antenna according to claim 14 wherein the second side portion of the band is of a length which provides an overlapping end, wherein the overlapping end overlaps a portion of the first side portion of the band, and wherein the overlapping end accommodates the tongue buckle for fastening together the first and second side portions of the band.

18. A dipole antenna according to claim 17 wherein the second side portion of the band has one or more buckle holes for engagement with the tongue buckle, and wherein at least one of the one or more buckle holes is disposed in the overlapping end of the second side portion of the band.

19. A tuning circuit for a dipole antenna in a wristwatch watchband, the tuning circuit comprising:

a fixed value inductor, and, a variable capacitor disposed in parallel with the fixed value inductor, wherein both the fixed value inductor and the variable capacitor are disposed in parallel with the dipole antenna, the dipole antenna comprising first and second component parts, the second component part of the dipole antenna having an aperture defined therein within a width of the second component and through a thickness of the second component part to reduce interference between the first and second component parts of the dipole antenna.

20. A tuning circuit according to claim 19 wherein the fixed value inductor is formed by a switchable inductor circuit switchable between two or more fixed inductances.

* * * * *